United States Patent [19]

Apprille, Jr.

[11] Patent Number: 4,756,082

[45] Date of Patent: Jul. 12, 1988

[54] RAZOR BLADE ASSEMBLY AND HANDLE THEREFOR

[76] Inventor: Domenic V. Apprille, Jr., 70 Decatur St., Arlington, Mass. 02174

[21] Appl. No.: 48,935

[22] Filed: May 12, 1987

[51] Int. Cl.[4] ..... B26B 4/14

[52] U.S. Cl. ..... 30/89; 30/57

[58] Field of Search ..... 30/89, 85, 57, 87, 50

[56] References Cited

U.S. PATENT DOCUMENTS

| | | | |
|---|---|---|---|
| 3,724,070 | 4/1973 | Dorion, Jr. | 30/47 |
| 3,754,326 | 8/1973 | Glaberson | 30/40 |
| 3,854,201 | 12/1974 | Dawidowicz | 30/40 |
| 3,935,639 | 2/1976 | Terry et al. | 30/47 |
| 3,938,247 | 2/1976 | Carbonell et al. | 30/47 |
| 3,950,849 | 4/1976 | Perry | 30/47 |
| 4,000,832 | 1/1977 | Pentney | 221/232 |
| 4,026,016 | 5/1977 | Nissen | 30/47 |
| 4,083,104 | 4/1978 | Nizzen | 30/47 |
| 4,168,571 | 9/1979 | Francis | 30/47 |
| 4,182,031 | 1/1980 | Cecil, Jr. | 30/47 |
| 4,270,268 | 6/1981 | Jacobson | 30/47 |
| 4,272,886 | 6/1981 | Asano | 30/47 |
| 4,309,821 | 1/1982 | Terry et al. | 30/32 |
| 4,488,357 | 12/1984 | Jacobson | 30/57 |
| 4,492,024 | 1/1985 | Jacobson | 30/87 |
| 4,492,025 | 1/1985 | Jacobson | 30/87 |
| 4,498,235 | 2/1985 | Jacobson | 30/47 |
| 4,551,916 | 11/1985 | Jacobson | 30/41 |
| 4,573,266 | 3/1986 | Jacobson | 30/41 |
| 4,612,704 | 9/1986 | Berretti | 30/47 |

*Primary Examiner*—E. R. Kazenske
*Assistant Examiner*—Willmon Fridie, Jr.
*Attorney, Agent, or Firm*—Scott R. Foster

[57] ABSTRACT

The present disclosure is directed to a shaving cartridge for use with a razor handle having a pair of cartridge engaging shell rocker bearings biased toward one another each of which has at least one undercut rocker bearing for receiving the cartridge. The cartridge has at least one blade thereon and has curved under surfaces pivotal upon and relative to the rocker bearing surfaces of the cartridge engaging shell rocker bearings. At least one protrusion extends from the curved under surfaces of the cartridge and is positioned to engage the shell rocker bearing surfaces on the cartridge when the cartridge is introduced to the shell bearings of the handle to bar reverse insertion of the cartridge in the handle so that the shaving blade of the cartridge when rockably engaged within the grip of the shell bearings is in a shaving ready position every time avoiding accidental reversal of the cartridge and its cutting blades when positioned on the handle for shaving.

4 Claims, 2 Drawing Sheets

RAZOR BLADE ASSEMBLY AND HANDLE THEREFOR

FIELD OF THE INVENTION

The invention relates to wet shaving implements and is directed more particularly to blade assemblies or cartridges which as a whole are rockably movable on a handle assembly and which have individual blade assembly components which are independently movable relative to one another and replaceable as a cartridge unit on the handle from a dispenser without accidentally reversing the cutting edge of the blade assembly cartridge relative to the handle resulting in an accidental cutting injury to the shaver.

DESCRIPTION OF THE PRIOR ART

It is known in the art to provide a razor blade assembly which may be connected to, and used in conjunction with, a razor handle to facilitate shaving operations. U.S. Pat. No. 3,724.070, issued Apr. 3, 1973, in the name of Francis W. Dorion, Jr. shows a blade assembly in which blade means are held between blade assembly surfaces adapted to engage the surface being shaved in front of and behind, respectively, cutting edge portions of the blade means. Such surfaces are generally referred to as "guard" and "cap".

It is further known that shaving efficiency of such a safety razor assembly may be improved if the blade assembly is adapted to pivot on the razor handle during a shaving operation, permitting the blade assembly to more closely follow the contours of a surface being shaved. U.S. Pat. Nos. 3,935,639, issued Feb. 3, 1976, in the name of John C. Terry, et al, and 3,938,247, issued Feb. 17, 1976, in the name of Nelson C. Carbonell, et al, are illustrative of razor handles adapted to accept the blade assembly of the '070 patent in such manner as to permit pivotal movement of the blade assembly during a shaving operation. U.S. Pat. No. 3,950,849, issued Apr. 20, 1976, in the name of Roger L. Perry, illustrates a modified blade assembly adapted for pivotal movement. U.S. Pat. Nos. 4,026,016, issued May 31, 1977, in the name of Warren I. Nissen, and 4,083,104, issued Apr. 11, 1978, in the name of Warren I. Nissen, illustrate, respectively, a blade assembly and razor handle comprising a shaving system in which the blade assembly pivots on the handle during shaving. The shaving system shown in the '016 and '014 patents has become well known world-wide.

Another means by which increased shaving efficiency may be obtained is that of retaining the blade assembly, as a whole, stationary but permitting movement of individual components thereof in response to forces encountered during shaving. In U.S. Pat. No. 4,168,571, issued Sept. 25, 1979, in the name of John F. Francis, there is shown a blade assembly in which the guard, cap and blade means are each movable independently of each other in dynamic fashion. U.S. Pat. No. 4,270,268, issued June 2, 1981, in the name of Chester F. Jacobson, shows a blade assembly in which the guard and blade means are independently movable.

In U.S. patent application Ser. No. 419,202, filed Sept. 17, 1982, now U.S. Pat. No. 4,492,024, in the name of Chester F. Jacobson, there is disclosed a safety razor blade assembly adapted for pivotal movement, as a whole, on a razor handle during a shaving operation, and further having blade means movable within the blade assembly in response to forces encountered during a shaving operation.

Also known in the art are the Chester F. Jacobson U.S. Pat. Nos. 4,492,025; 4,498,235 and 4,551,916 directed to the replaceable cartridge pivotally mounted on a shaving handle.

SUMMARY OF THE INVENTION

An object of the present invention is to provide an improved safety razor blade assembly of the type disclosed in the above referred to U.S. Ser. No. 419,202, now U.S. Pat. No. 4,492,024.

With the above and other objects in view, as will hereinafter appear, a feature of the present invention is the provision of a safety razor blade assembly comprising blade means having cutting edge means disposed between skin engaging elements adapted in operation to engage a surface being shaved ahead of and behind, respectively, the cutting edge means, the blade means being movable relative to the elements in response to forces encountered during a shaving operation, the blade assembly having pivot mounting means thereon for pivotal attachment to a razor handle assembly, whereby the blade assembly, as a whole, is pivotally movable on said handle assembly in response to forces encountered during the shaving operation.

A further object of the present invention is to provide the underside of the cartridge with a protrusion which cooperates with a handle bearing having a cutout relieved to the centerline so that if it is introduced backward, the protrusion prevents the bearings from engaging and the shaver cannot have an accident with the cartridge. The bearings on the handle will only engage the cartridge and be free to rock or rotate relative to the handle when the cartridge and the cutting edges of its blades are properly directed for shaving.

The above and other features of the invention, including various novel details of construction and combination of parts, will now be more particularly described with reference to the accompanying drawings and pointed out in the claims. It will be understood that the particular device embodying the invention is shown by way of illustration only and not as a limitation of the invention. The principles and features of this invention, may be employed in various and numerous embodiments without departing from the scope of the invention.

DESCRIPTION OF THE PREFERRED EMBODIMENT

Figure 1:
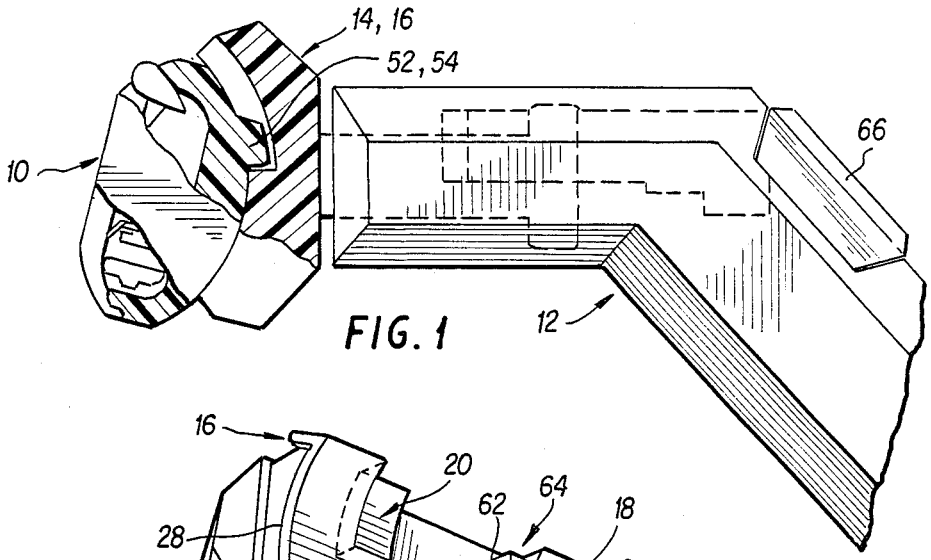
FIG. 1 is a side elevational view with parts broken away and parts shown in section of the razor handle and cartridge constructed in accordance with the present invention.

This invention is directed to a shaving blade cartridge assembly 10 for use with a razor handle assembly 12 having a pair of pivotally mounted cartridge engaging shell bearings 14, 16 biased toward one another. The bearings 14, 16 have on their bearing surface portions discontinuous with the bearing surfaces, the discontinuous portions comprising undercut recesses 18, 20 for receiving the cartridge 10. The cartridge 10 has a pair of shaving blades as described in the above prior art.

Figure 6:
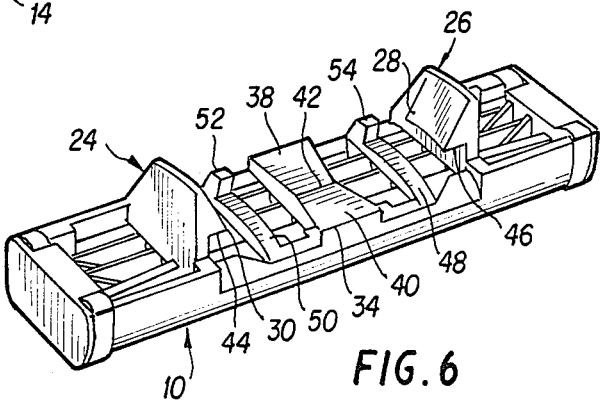
FIG. 6 is an underside perspective view of a cartridge to be employed with the handle of the present invention.

On the underside of the cartridge assembly, best seen in FIG. 6, are disposed two extensions 24, 26 having at their free ends, respectively, inwardly extending opposed rails 28, 30, each rail having respective arcuate upper surfaces 68, 70. The extensions comprise a pivot mounting means by which the blade assembly may be removably and pivotally attached to the razor handle 10. The blade assembly body member underside is additionally provided with cam means 34, comprising surfaces 38, 40 joining at an apex 42.

Figure 2:
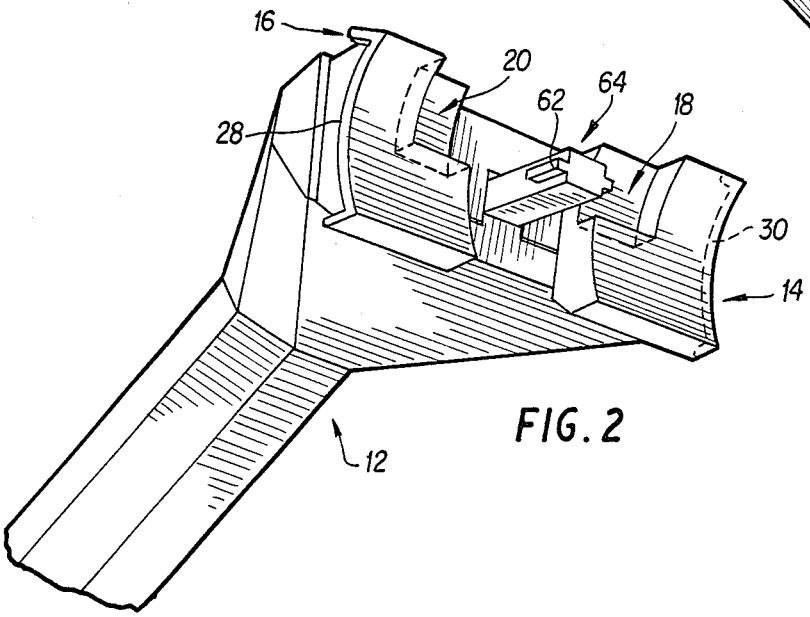
FIG. 2 is a fragmentary perspective view of the razor handle constructed to retain the shaving cartridge of the present invention.

The cam means 34 is adapted to receive a cam follower 62, best seen in FIG. 2, operative to urge the blade assembly to a given position.

Figure 3:
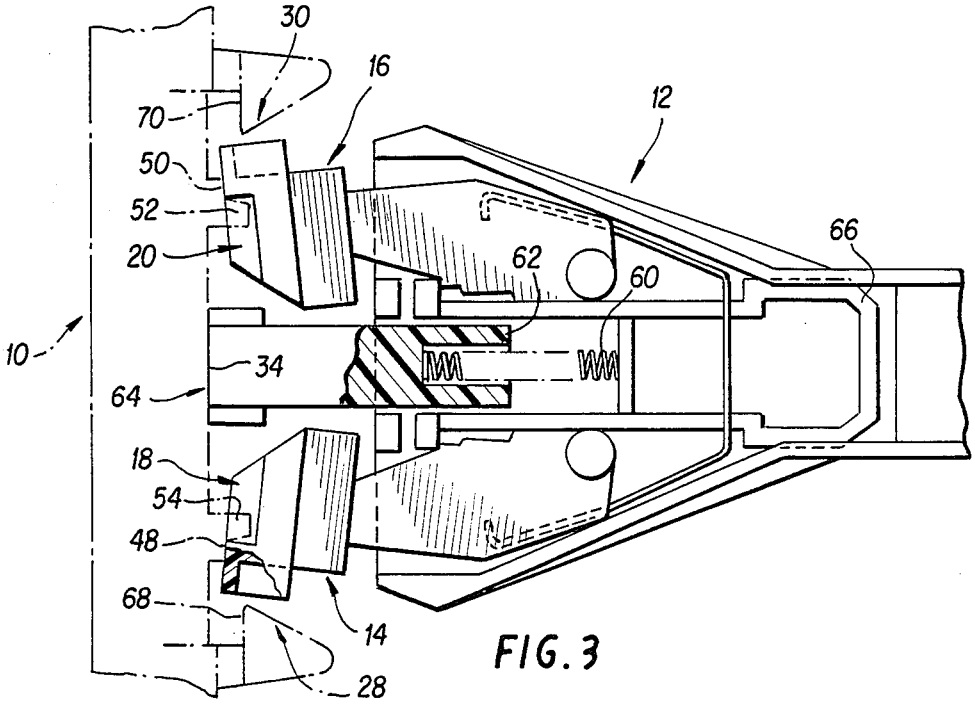
FIG. 3 is a top plan view of the handle assembly with parts broken away and parts shown in section with the shell bearing jaws in preliminary cartridge engaging position and the cartridge shown in chain line.
Figure 5:
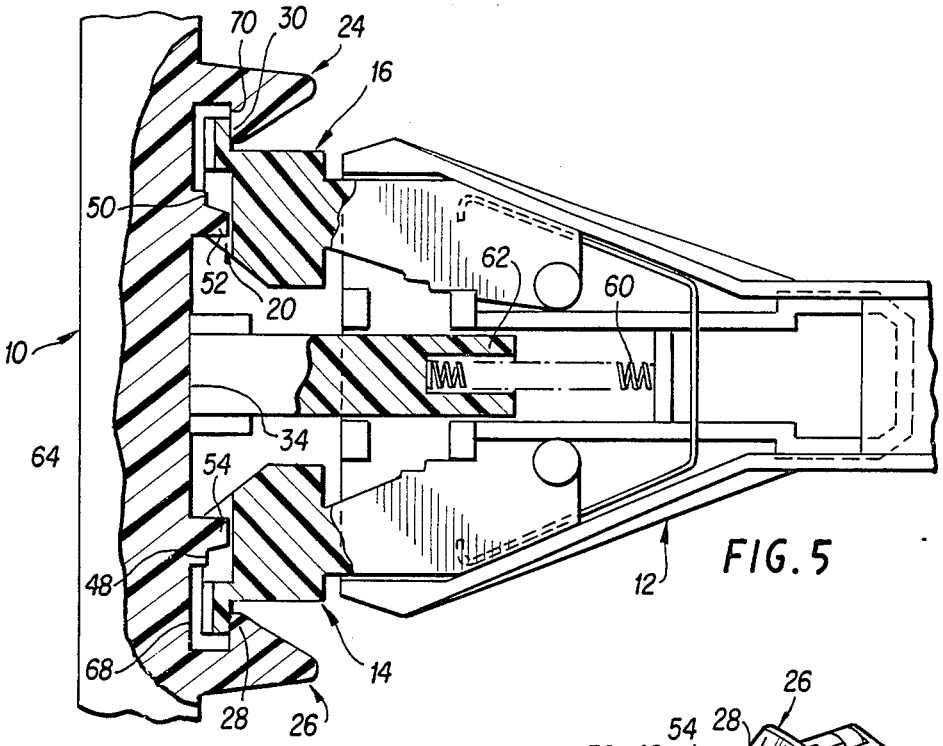
FIG. 5 is a top elevational view of the razor handle constructed in accordance with the present invention with parts broken away and parts shown in section with the cartridge fully engaged with the handle.

Blade assembly rails 44, 46, shown in FIG. 6, in conjunction with under surfaces of the cartridge body member 10 and arcuate struts 48, 50 form recesses for receipt of the handle shell bearings 14, 16 to interconnect the handle and shaving cartridge 10 (FIG. 1, 3 and 5). Formed on the struts 48, 50 are surface portions discontinuous with the curved surfaces of the struts the discontinuous portions comprising protuberances 52, 54 which cooperate with the arcuate undercut recesses 18, 20 in the shell bearings 14, 16 to assure proper alignment of the cartridge 10 with the handle 12. Accordingly the cartridge blades when rockably engaged with the shell bearings 14, 16 are in shaving ready position everytime, avoiding accidental reversal of the cartridge and its cutting blades when positioned on the handle 10 for shaving.

In accordance with the invention it is material that at least one of the cartridge blade assembly curved under surface struts 48 has a protuberance discontinuous with the under surfaces and complemental to the bearing surface discontinuous portion i.e. the undercut recesses 18, 20. The blade assembly discontinuous portion is engagable with the shell bearings 14, 16 discontinuous portion 18, 20 upon connection of the blade assembly 10. The respective protuberance portions 52, 54 bar the interconnection of the blade assembly and cartridge assembly when the cartridge assembly 10 is introduced to the handle assembly 12 in other than a correct shaving attitude, as shown in FIG. 4.

In the handle recess there is disposed a coil spring 60 and a plunger 62, the spring 60 biasing the plunger in the direction of the free end 64 of the plunger member 62. When the blade assembly 10 is connected to the handle assembly 12, the free end 64 of the plunger 62 is urged by the spring 60 into engagement with the blade assembly cam means 34.

During pivoting operation of the blade assembly, the plunger end 64 bears against the cam surfaces to urge the blade assembly to a given position.

Figure 4:
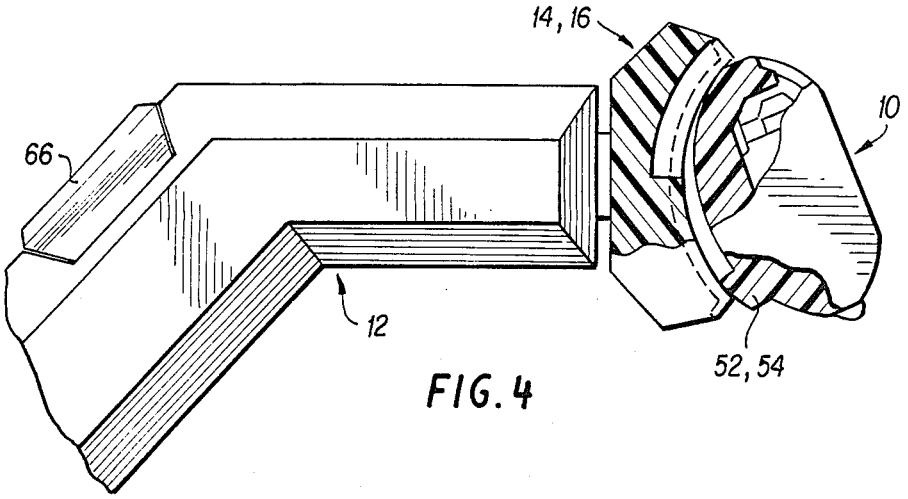
FIG. 4 is a side elevational view similar to FIG. 1 with the cartridge in the protrusion barred entry position.

Referring particularly to FIG. 1 and 4, it will be seen that the bearing shells 14, 16 extend beyond the sides of the handle 12 and are accessible to an operator. To connect the blade assembly 10 to the handle assembly 12, the operator presses the shell actuating button 66 inwardly so that the shells jaws move toward each other moving the shell bearings 14, 16 toward each other, as shown in FIG. 3.

The shell bearings 18, 20 are then pressed against the blade assembly 10 underside arcuate struts 48, 50 and the shell bearing 14, 16 are released. Upon their release, the protuberances 52, 54 are in proper registry with the undercut portions 10, 20 the bearings 14, 16 will properly engage the cartridge.

During a shaving operation the guard blades as described and illustrated on the prior parts move independently of each other against the bias of the spring fingers. Simultaneously, the blade assembly 10, as a whole, pivots on the handle 12, following the contours of the surface being shaved.

When it is desired to discard a used cartridge assembly 10, the operator need only press the button 66 which compresses the recesses, releasing the cartridge 10.

What I claim is:

1. A razor and blade assembly comprising a razor handle assembly having a bent handle portion and a pair of arms pivoted to and extending from said handle portion, each of said arms having thereon a rocker bearing shell, each of said rocker bearing shells having on its bearing surface a flat walled cut out surface, the walls and bottoms of which are at right angles to each other defining a projection movement limiting slot in the bearing shell surface, and a blade assembly having curved under surfaces complementarily engagable with said rocker bearing shells and their cut out surfaces, said blade assembly being rockable on and relative to said rocker bearing shell cut out surfaces, parallel arcuate struts on the curved under surface of each blade assembly, at least one projection upstanding from one of said struts positioned for entry into the cut out recesses of said bearing shells carried by said handle, said projection movement limiting slots in said bearing shell surfaces and said projections on each of said arcuate struts being so positioned as to permit the projections on said struts to enter said slots only when the razor blade assembly is positioned in the rocker bearing shells on the razor handle assembly in a shaving ready position, said projections being of such height as to prevent coupling of said blade assembly to the handle assembly when said handle assembly is positioned relative to the blade assembly so that said projections do not enter the slots in said rocker bearing shells.

2. A razor handle and blade assembly as claimed in claim 1, further comprising blade assembly attaching hooks having under cut upper surfaces engagable with the underside of each bearing shell to lock the blade assembly to the handle while permitting relative rocking movement between the handle and blade assembly to shave a body area.

3. A razor handle and blade assembly as claimed in claim 2, further comprising spring means and a plunger carried by said handle and positioned so that the plunger under action of the spring will bear against the blade assembly to maintain a rocking contact between the bearing shell and the arcuate upper surfaces of the attaching hooks on the underside of said blade assembly.

4. A razor handle and blade assembly as claimed in claim 1, wherein the leading cutting edges of said blades when in the shaving position are positoned at an angle between said blade assembly and said handle.

* * * * *

UNITED STATES PATENT AND TRADEMARK OFFICE

CERTIFICATE OF CORRECTION

PATENT NO. : 4,756,082

DATED : July 12, 1988

INVENTOR(S) : DOMENIC V. APPRILLE, JR.

It is certified that error appears in the above-identified patent and that said Letters Patent is hereby corrected as shown below:

On the title page the following should be inserted:

--[73] Assignee: The Gillette Company, Gillette Park, Boston MA--.

Signed and Sealed this

Thirteenth Day of December, 1988

*Attest:*

DONALD J. QUIGG

*Attesting Officer*

*Commissioner of Patents and Trademarks*